US005412918A

United States Patent [19]

Wendel et al.

[11] Patent Number: 5,412,918

[45] Date of Patent: May 9, 1995

[54] ATTACHMENT SYSTEM FOR MODULAR PANELS

[75] Inventors: Christopher M. Wendel, Westfield, N.J.; Donald A. Whamond, Downers Grove, Ill.

[73] Assignee: Exhibit Group, Inc., Roselle, Ill.

[21] Appl. No.: 145,790

[22] Filed: Oct. 29, 1993

[51] Int. Cl.[6] ..... E04C 3/00

[52] U.S. Cl. ..... 52/582.1; 52/DIG. 13; 403/13

[58] Field of Search ..... 52/582.1, 583, 585, 52/586, 595, DIG. 13; 160/135; 403/13, 14; 24/306

[56] References Cited

U.S. PATENT DOCUMENTS 4,028,855 6/1977 Prewer ..... 52/DIG. 13 X 4,947,527 8/1990 Hennig ..... 24/575

*Primary Examiner*—Carl D. Friedman
*Assistant Examiner*—Creighton Smith
*Attorney, Agent, or Firm*—Joseph H. Roediger

[57] ABSTRACT

A novel attachment system provides rapid alignment and attachment of adjacent modular panels which eliminates interpanel support members and permits individual panel reversal. The system utilizes pairs of substrates affixed to each panel edge. Each substrate has a plurality of tapered pins and sockets for alignment. Portions of the panel edges are provided with releasable VELCRO-type fasteners for attachment. Disassembly is accomplished by the application of tension to adjacent panels accompanied by a bending force at the junction therebetween.

18 Claims, 5 Drawing Sheets

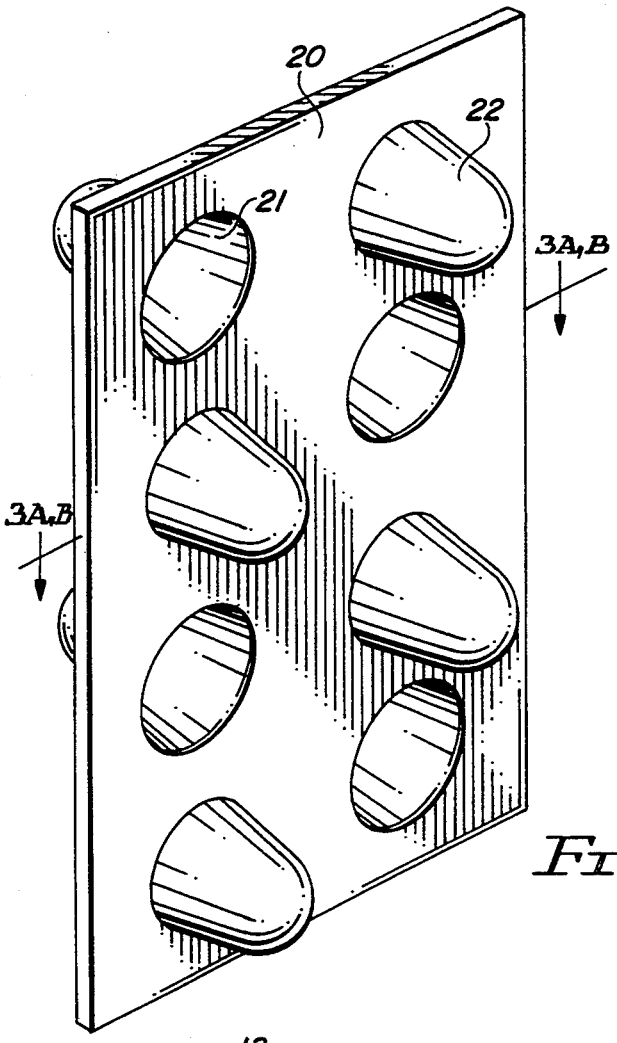
FIG. 2
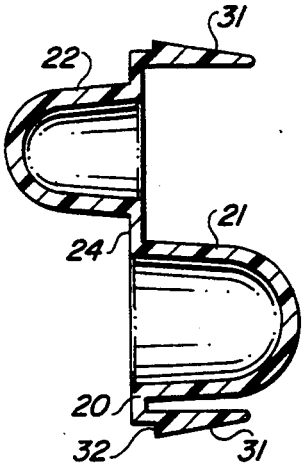
FIG. 4
FIG. 5
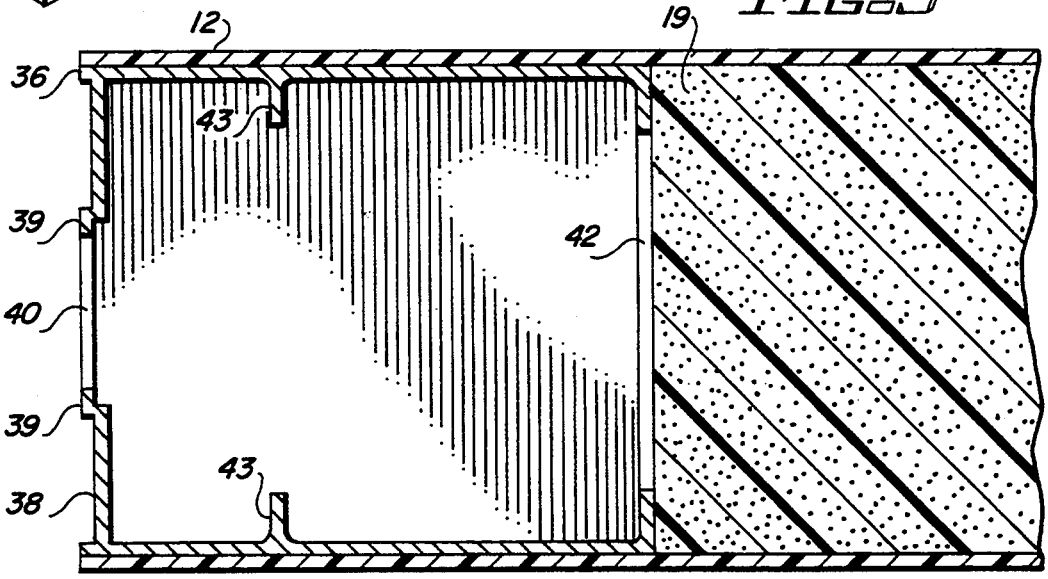

ATTACHMENT SYSTEM FOR MODULAR PANELS

BACKGROUND OF THE INVENTION

This invention relates to modular panels of the type used for temporary exhibition or display purposes and, in particular, to a novel attachment system for directly joining adjacent panels without requiring intermediate support members.

The use of nonpermanent structural assemblies to create bounded work and exhibition spaces is ever increasing due in part to the large number of trade shows and conventions being held each year to stimulate interest in products and services. To attract trade show and convention business to cities, the city must not only have suitable lodging facilities and amenities, but also a large area exhibition hall or convention center. The large area is typically leased in small parcels to users who define and create a workplace according to their own requirements. Whether the exhibitors or the staff of the facility deploy the space dividers and attachments thereto, the objective is to provide an attractive appearing place in which to conduct business at a minimum cost for a short period of time. The costs associated with the use of the leased facilities require that assembly and disassembly of the dividers and associated equipment be accomplished in a short period of time, normally with unskilled labor.

Typically, temporary display surfaces and space dividers utilize a multiplicity of modular panels joined together through the use of intermediate support posts which receive a variety of locking devices. Presently known panel arrangements used to define exhibition and work space suffer from a variety of deficiencies which limit the usefulness of such arrangements. One problem found in such arrangements is the difficulty encountered in joining the individual panels one to another and, once joined thereafter easily separating the panels for rearrangement or relocation. Another disadvantage is the requirement that many systems have a need for elaborate columnar sections which detract from the overall appearance and also reduce the wall space available for display. The connecting hardware in many of these partitions utilizes threaded members which secure panels to the individual columns. In order to reduce the number of parts that must be handled in the assembly of space dividers, it has been common to provide the columns with channels that receive splines attached to the ends of the modular panels. The complexity of these structures calls for the use of experienced personnel to assemble the structures and greatly increases the number of steps involved in both assembly and disassembly.

To overcome the problems associated with intermediate columns and end posts which receive the fixtures secured to individual panels, attempts have been made to provide portable space providing systems utilizing releasable fabric fasteners. One such system is shown in U.S. Pat. No. 4,635,418 wherein wall panels consisting of loop fabric bonded to a foam core are joined together by hook tape to form wall systems which do not require tooling for assembly. The covering of an entire modular panel with fabric fastener limits the number of uses to which the panel can be used for display purposes. This type of covered panel lacks many of the aesthetic qualities felt desirable in the bounding of exhibition and display space. Furthermore, the lack of any rigid connection in structures of this type renders them unsuitable for use wherein the panels are large and the numbers of passerbys are great. Another such system is shown in U.S. Pat. No. 4,028,855 wherein the adjacent partitions rely on fabric fasteners for providing an attached juncture between adjacent panels. In this reference, the problem of instability is recognized for it is suggested to utilize panels in abutting relationship with both the ceiling and floor. This type of construction is not practical in the large convention areas utilized in this country. Another alternative is shown in U.S. Pat. No. 4,722,146 wherein fabric hinges are used to connect adjacent modular panels. The panels in this reference utilize a connector member which fits in grooves formed in adjacent frames. The structure requires the placement of end caps on panels with fabric hinges in between when using a series of panels to define a display area. The use of the fabric hinges enables the displays to be transported without disassembly. This type of construction imposes space requirements and perhaps limitations at each successive exhibition site. A degree of flexibility of display is lost if the ability to add and subtract panels to the display both horizontally and vertically, is surrendered. In order to accomplish a change in this structure, the workmen must be familiar with the interaction of the multiple parts so as not to damage them or the panels during removal and subsequent reassembly.

Accordingly, the present invention is directed to a modular panel for use in connection with portable displays and for bounding semi-permanent work places wherein the individual panels can be rapidly and easily interchanged and, if need be, reversed. The versatility of the modular panel of the present invention enables the partitions being erected to quickly form walls and corners varying in height and length without requiring the use of threaded fastening members, columnar intermediate and end posts, and associated hardware. Furthermore, the subject invention provides a panel that can be reversed end for end or top for bottom allowing for alternate plan layouts or to present a fresh surface to the viewer in the case of a defacing of or damage to the original surface.

A primary object of the present invention is to provide a lightweight modular panel that can be quickly aligned and easily affixed both at corners and on linear walls to adjacent panels by inexperienced assemblers. In addition, the modular panel utilizes the significant benefits of molded plastic releasable fasteners in combination with a novel alignment device which assists in assembly, maintains the integrity of the juncture between panels and facilitates disassembly of adjacent panels. The present construction of nodular panels enables panels to be constructed without the use of wood or metal components to reduce the weight and cost of panels. The elimination of separate structural support elements such as columnar intermediate and end posts permits a series of modular panels to be adjacently disposed and display a continuous wall which is unbroken by sections of different materials or appearance.

SUMMARY OF THE INVENTION

The present invention is directed to an alignment device for use in attaching modular panels one to another and a modular panel having the alignment device affixed thereto. The alignment device is used to facilitate assembly between adjacent panels and utilizes a plurality of pin and socket pairs to achieve panel alignment and impart structural rigidity to assembled panels.

The alignment device comprises a planar substrate which is attached to a side edge of a panel. Formed in the planar substrate is at least one receiving socket and laterally adjacent thereto is a pin projecting from the substrate. The combination of laterally adjacent pin and socket form a pair which is reversed in orientation from a receiving pair. The receiving pair is part of a like device affixed to an adjacent panel. The modular panel receiving the alignment device is formed with a frame having top, bottom and opposing side members. First and second alignment devices are affixed to one of the side members in spaced relationship with each located the same distance from the top and bottom members of the frame. Releasable fastening means is affixed to the side member when brought into contact with fastening means on like panels. The alignment devices register the adjacent panels and the pins and sockets are received by their counterparts on an adjacent panel to provide both alignment during assembly and structural rigidity to the wall assembly. When the pin and socket pairs are mated with the pairs on the adjacent panel, the releasable fastening means affixed to the panels are then urged into mutual contact to secure the engagement between panels. The separation of adjacent modular panels utilizing the present invention is accomplished by applying a separating force and a bending force at the juncture of the panels.

The socket formed in the alignment device is tapered and the pin preferably has a rounded end to facilitate placement of the pin in the socket during alignment. In addition to providing rapid alignment between panels, the interaction between the fastening means and the pin and tapered socket pairs enables a rapid release of the adjacent panels to be achieved. The application of a tension force between adjacent panels causes limited initial movement between the adjacent fabric fasteners which results in a pin and its receiving socket having clearance established therebetween. As the pin is withdrawn slightly from the socket, the clearance permits the application of a bending force normal to the panel to complete the release of the fabric fasteners. Thus, panel separation can be affected rapidly by the application of the combination of forces.

In the preferred embodiments, each alignment device comprises four pairs of pin and socket with each pair being laterally aligned and displaced from an adjacent pair. The pairs are alternately oriented so that each pin is directly adjacent a socket on all sides. This configuration of alignment device is universal in that it is utilized on the side edges of a number of modular panels, each having fabric fasteners along the side edges. As a result, the modular panels are interchangeable and can be reversed top for bottom and side for side and still permit affixation to an adjacent panel. The alignment devices can be attached by suitable adhesive to the modular panel or, alternatively, the modular panel can be provided with an opening and the planar substrate formed with depending tabs. The tabs can be inserted into the opening of the panel and secured by the combination of tabs and the edge of the opening. The latter construction permits a changeout in the event that one of the alignment devices is damaged.

Thus, the present invention provides a modular panel that can be rapidly attached to an adjacent panel without the use of an intermediate post or additional fixtures. No threaded members are utilized in the assembly process and in fact no parts not secured to the modular panel itself are necessary to assemble a wall of modular panels. The side edges of the modular panels can be formed at a forty-five degree angle to the surface of the panel. This lets the panels form a corner or a linear wall as described.

Further features and advantages of the invention will become more readily apparent from the following detailed description of preferred embodiments thereof while taken in conjunction with the accompanying drawings.

BRIEF DESCRIPTION OF THE DRAWINGS

FIG. 2 is a perspective view showing the alignment device in the embodiment of FIG. 1.

FIG. 4 is a side view in section of a second embodiment of the invention.

FIG. 5 is a cross-sectional view of an edge member of a second embodiment of the invention for receiving the device of FIG. 4.

FIG. 6 is a plan view showing adjacent panels prior to assembly.

DESCRIPTION OF THE PREFERRED EMBODIMENT

Figure 1:
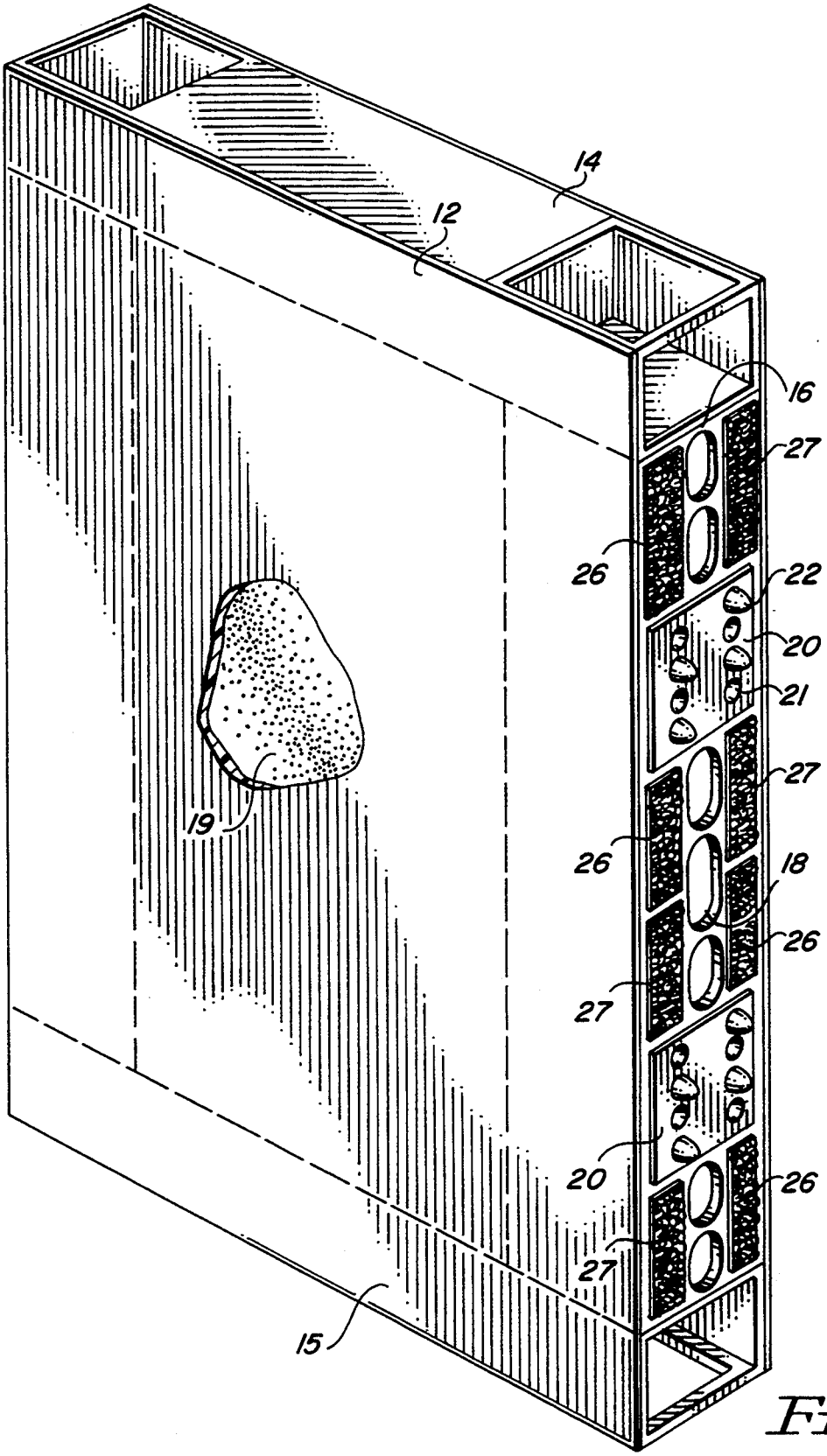
FIG. 1 is a view in perspective of a modular panel containing a preferred embodiment of the invention.
Figure 9:
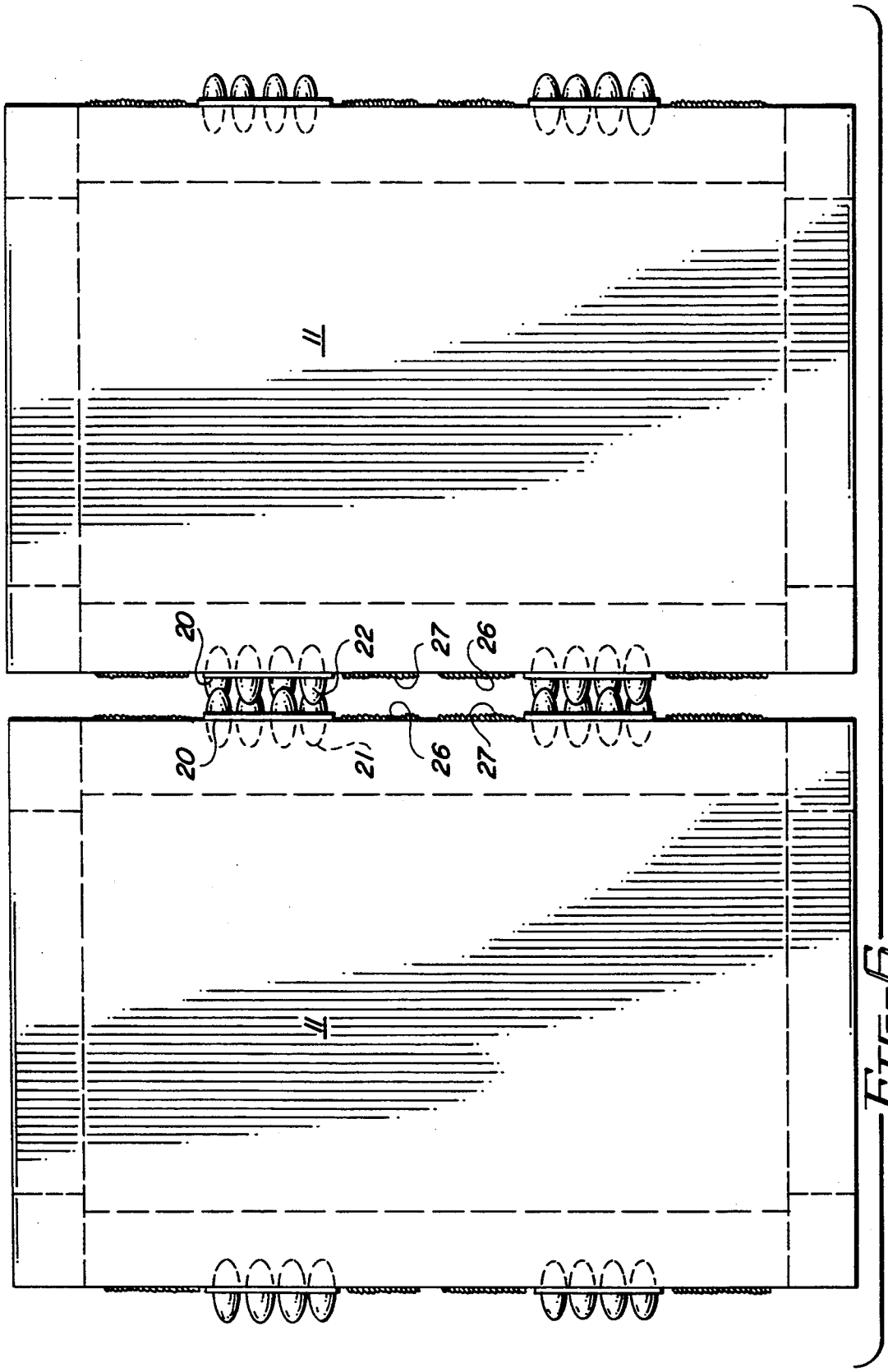

Referring now the FIG. 1, a modular panel 11 is shown constructed of a top cross member 14 and a bottom cross member 15 with edge members therebetween defining the sides of the panel. In the perspective view of FIG. 1, edge member 16 is shown and it is to be noted that a similar member is located on the opposing edge of panel 11. The cross members and edge members bound a foam core 19 shown in the cutaway portion of FIG. 1. Sheet material 12 is used to provide the panel surface and is adhered to the exposed surface of foam core 19 and the adjacent areas of the cross and edge members. While the members may be bonded together, the preferred embodiment utilizes extruded plastic cross and edge members aligned with and placed against the edges of the foam core. A plastic sheet overlay is used to form an integral panel relying the adhesive used with sheet 12. The sheet material is applied to the opposing large area surfaces of the panel and eliminates the need for bonding between cross and edge members. In the embodiment shown, the foam core is made of expanded polystyrene, the cross and edge members are made of abs plastic and the sheet material applied as the panel coating is a pvc/acrylic mixture of 1.0 mm thickness and having an adhesive coating on one side thereof. A transfer coating is normally used to protect the adhesive until application to the panel assembly. Alternatively, the cross and edge members may be made from extruded aluminum which requires affixation of the adjacent members, typically by welding.

The modular panel 11 is rectangular in shape and the surface of the edge member 16 is used to receive the alignment devices and fabric fasteners which enable it to be rapidly and effectively joined to an adjacent panel during assembly. The edge member 16 is shown with a number of elongated apertures 18 formed in the surface thereof to reduce the overall weight of the panel and to receive the sockets formed in the alignment device.

Other apertures are formed in the interior surface of the edge members as well as the cross members.

Edge member 16 is provided with apertures that receive the alignment devices comprised of substrate 20 with the plurality of pin and socket pairs formed thereon. The cutout portion underlying each of the substrates 20 affixed to its member 16 is smaller than the outline of the substrate to permit contact therebetween and to allow the sockets 21 to extend inwardly of the surface of edge member 16. Substrate 20 of the preferred embodiment, formed of abs plastic, is adhered to the surface of the edge member by a suitable adhesive. Each substrate 20 contains four pairs of pin and socket combinations with each adjacent pair being reversed in orientation. As a result, the immediate neighbor of each pin is a socket and vice-versa. It is to be noted that the pin and socket in each pair are positioned laterally adjacent one another. As shown, each pin and socket in a pair are horizontally aligned. The lower substrate is configured in the same manner as is a pair of substrates (not shown in FIG. 1) located on the opposing edge member of panel 11.

A plurality of patches of a releasable/reclosable fastener are affixed to the surface of edge member 16. With hook and loop fasteners such as VELCRO used in the embodiment of FIG. 1, the hook sections 26 are formed near one vertical edge and the opposing edge is provided with loop sections 27 in the top half while it is reversed in the bottom half of the panel. This pattern repeats itself on all edge members of modular panels including the opposing edge member of panel 11. In embodiments using a hook to hook fastener such as DUAL-LOCK, the same material may be utilized in patches 26 and 27. Also, it is to be noted that the cross members 14 and 15 are each provided with end openings to accommodate electrical wiring if employed with the panel assembly. Adjacent openings are shown in the top and bottom edges to accommodate overlying electrical fixtures if utilized or to permit the insertion of a vertical pilar to receive another modular panel thereon. The location of the openings in the cross members can be varied based on the particular design used. The position and size of these openings in the top and bottom members do not effect the alignment device and fastening means described in connection with the present invention.

Figure 3A:
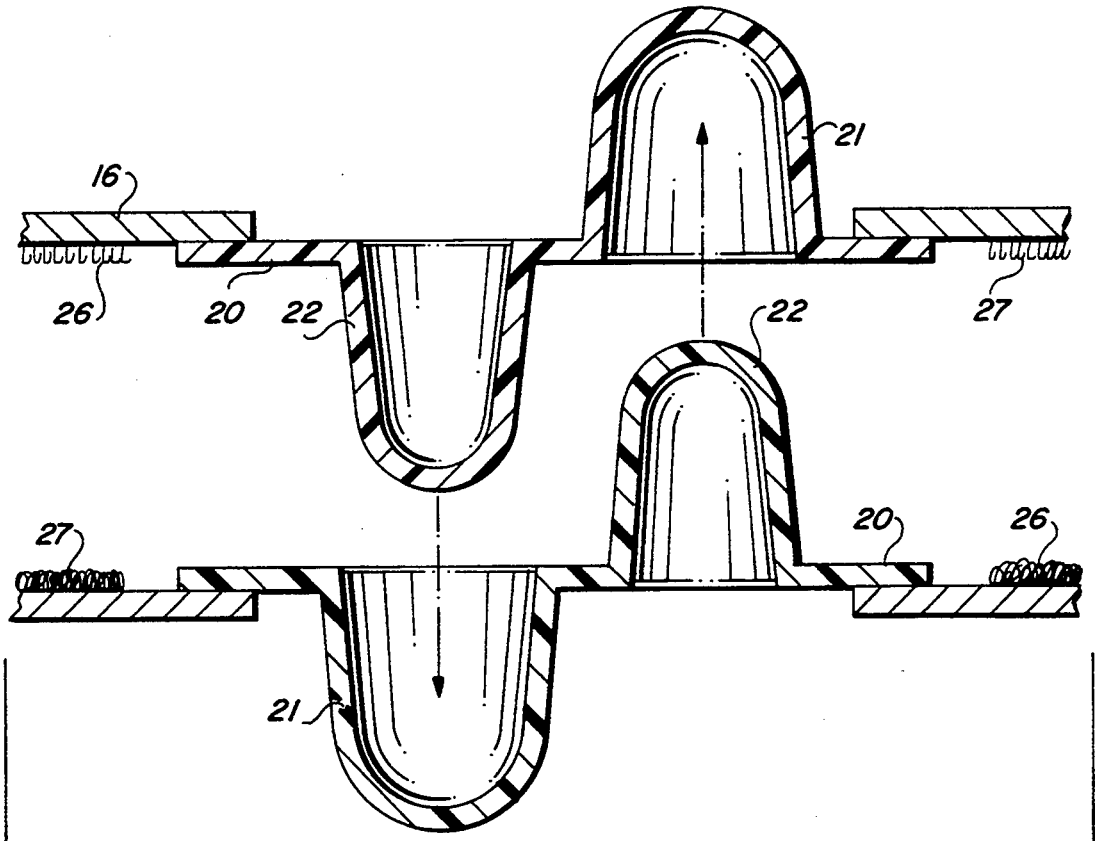
FIGS. 3A and 3B show the interaction of adjacent alignment devices as shown in FIG. 2.
Figure 3B:
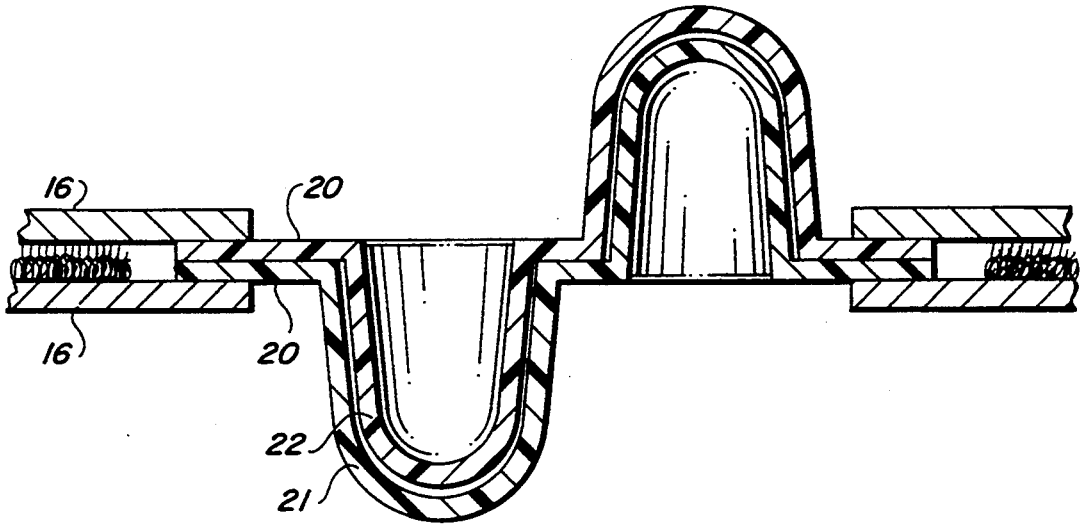

The alignment device shown in the embodiment of FIG. 1 is seen in greater detail in FIG. 2 wherein the planar substrate 20 is shown having four pins and four sockets formed therein. The alignment device is formed of rigid molded plastic with each socket horizontally aligned with an adjacent pin 22. In the cross sections of FIGS. 3A and 3B, the interaction of adjacent alignment devices is depicted. The socket 21 is formed with a tapered inner surface and a concave end. The pins 22 in the preferred embodiment are tapered and formed to be slightly undersize in width and length. Thus, when the alignment devices are urged firmly together as shown in FIG. 3B, clearance exists between the pin 22 and the socket 21. Also shown in FIGS. 3A and 3B are the hook and loop fabric fasteners 26 and 27 respectively. As the alignment devices are urged together so that the substrates 20 are in contact with each other, the fasteners form an interlock and maintain the substrate 20 in contact during normal operation. Thus, the edge members 16 of adjacent modular panels are separated by the thickness of the two substrates 20.

In operation, the addition of a modular panel to an existing modular wall system is accomplished by aligning the pin and socket pairs of each alignment device with the pairs of the like alignment device on the exposed edge of the receiving modular panel. When these pins and sockets are in general alignment, the additional panel is urged into contact with the exposed edge of the wall as shown in FIG. 3B. In the event that the modular panel contains a display or there is a continuous design being shown and the panels are to be aligned in a different manner, the panel being aligned can be reversed side to side or top to bottom as the case may be. This change in attitude of the modular panel being added is achieved without altering the existing wall system clue since each alignment device contains a like number of pin and socket pairs oriented the same with identical spacing. Furthermore, the use of two alignment devices spaced an equal distance from the top and bottom cross members as shown in FIG. 1 ensures that a top to bottom reversal will find the same orientation of alignment devices. As a result, flexibility in forming modular wall systems is achieved without requiring any changes in the alignment devices, fastening means or fixtures normally associated with modular panels.

The novel alignment device utilized in the present invention preferably includes multiple pin and socket combinations with alternate combinations being alternately oriented or reversed. This configuration adds structural support to the assembly and ensures that an adjacent panel will have a like alignment device positioned to receive the pins and present sockets for pins. However, the pins and sockets may be vertically aligned rather than reversed if desired. In this case, the top and bottom alignment devices are alternately oriented on all panel side edges. While the use of tapered sockets and concaved ends facilitate the relative positioning of adjacent panels prior to affixation, the clearance shown in FIG. 3 has greater significance during the disassembly phase. Typically, releasable fasteners resist tensile forces especially when the fasteners are large in area. Thus, it is traditional to peel the fasteners one from the other for separation. However, the modular panels have large area fasteners affixed to rigid edge members 16 thus preventing the peeling apart of adjacent fastener surfaces. It is recognized that releasable fasteners do provide a limited relative movement which can be utilized in the present situation to increase or, in the case of embodiments wherein no clearance is provided between pin and socket, to provide a working clearance which enables a bending force to begin to peel back the opposing fasteners. In other words, the presence of a clearance between pin and socket when the tensile force is first applied between adjacent walls coupled with the application of a bending force at the juncture results in a compression of the releasable fasteners on one side of the alignment device and a separation or peeling apart of the fasteners on the other side. As a result, the panels can be readily disassembled without harming the pins or the alignment devices. While the amount of play in fasteners of this type varies, the use of a relatively long fibered releasable fabric fastener to allow sufficient movement to prevent damage to the pins in the case where no clearance exists between pin and socket is to be avoided. A loose fit between adjacent panels is likely to create instability in the modular wall system. Consequently, the preferred embodiments call for clearance between pin and socket preferably by the use of a tapered socket having a concave end. The pin is provided with a rounded end to facilitate relative movement should it contact the wall of the socket during disassembly. Similarly, the pin length should be less than the depth of the socket to provide clearance about the entire surface of the pin.

In the embodiment of FIG. 1, the substrate 20 is adhered to the surface of the edge member 16 about a receiving opening (not shown) and the releasable fastener patches 26, 27 are also adhered to the surface. Another embodiment shown in FIGS. 4 and 5 eliminates the need for adhesive between substrate and edge member 16. This embodiment enables an alignment device to be replaced relatively easily should it be damaged during assembly. As noted in FIG. 4, the substrate 20 is provided with depending tabs 31 affixed to the opposing side edges thereof. The tabs extend outwardly from the side edges of the substrate 20 to form shoulders 32. The alignment device of FIG. 4 is inserted into the opening 40 formed in edge member 36. The opening is bounded by walls 39 which receive the tabs 31 of the alignment device. When inserted, the shoulder 32 rests under the wall 39 to prevent withdrawal of the device from opening 40. The top and bottom edges of the substrate 20 are made slightly oversized to prevent the alignment device from moving into the opening. This is shown by the central portion of the device of FIG. 4 being raised above the surface of the edges of the substrate. The height of the shoulder 32 is equal to the thickness of the wall 39 surrounding opening 40. Adjacent the opening are channels 38 formed in the surface of the edge member 36. These panels are provided to accommodate a strip of releasable fastener oriented in the manner shown with the embodiment of FIG. 1. In this case, a single fastener strip can be utilized on either side of the opening 40 extending along the length of the edge member 36. As mentioned previously, the edge members are extruded elements typically formed of abs plastic with cutouts to lower the overall weight of the structure. One such cutout 42 is shown adjacent foam core 19. Opposing tabs 43 are shown extending inwardly to ensure that any vertical posts used to fasten tiers of modular panels will not interfere with the alignment device located in opening 40.

Figure 7:
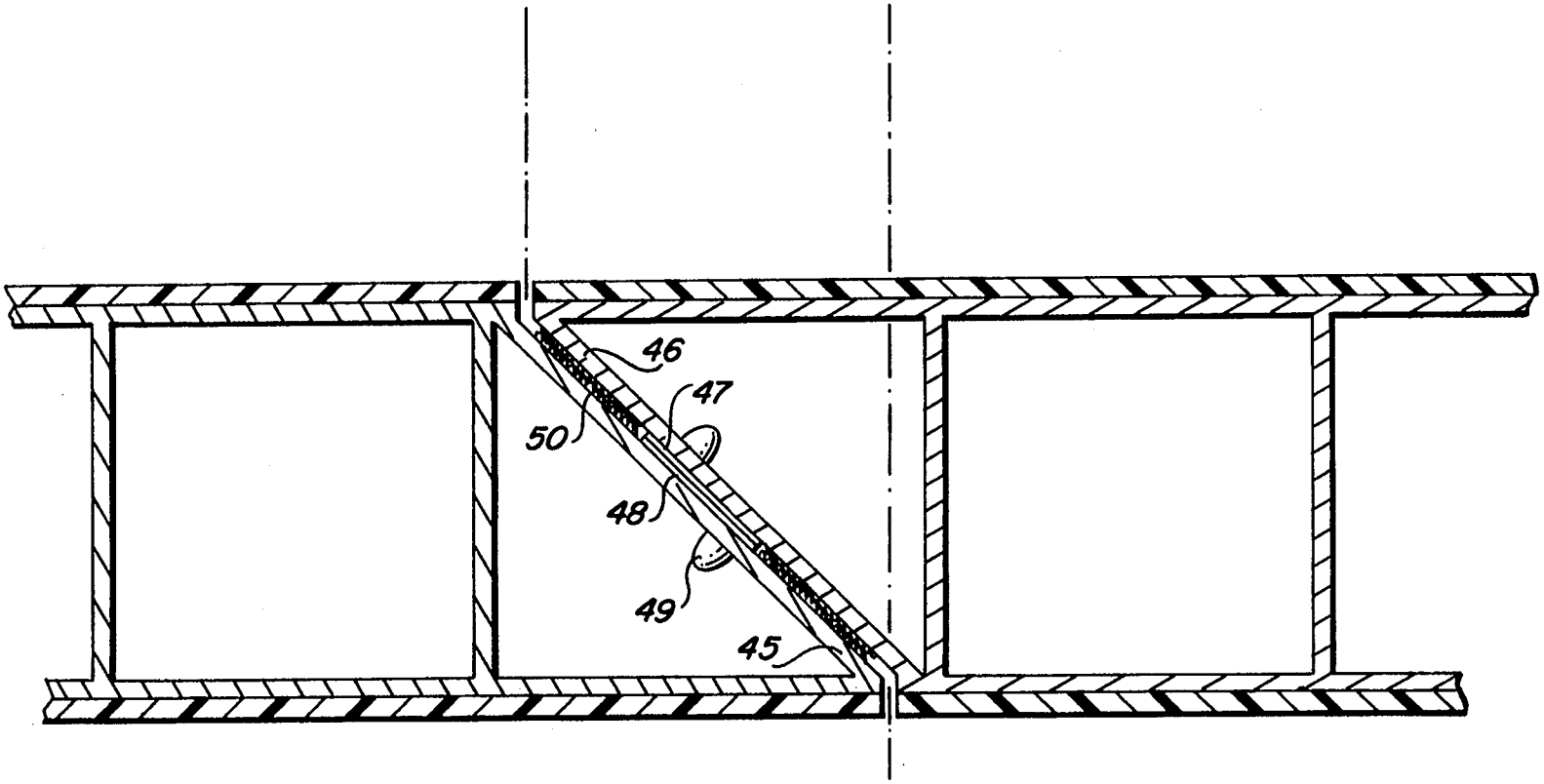
FIG. 7 is another embodiment showing the alignment device on panels with a forty-five degree side edge.

The orientation of two adjacent modular panels 11 having standard ninety degree side edges placed in position to be affixed one to another is shown in FIG. 6. It is noted that each alignment device has four pin 22 and socket 21 combinations with each side edge 16 having two alignment devices. The alignment devices are located the same distance from the corresponding top and bottom edges. Thus, the structure is reversible side for side and top for bottom. The orientation of the releasable fasteners is identical for all side edges. If a hook to hook fastener is used the patches of fasteners are identical. However, in the event that hook and eye fabric is utilized, the hook material is affixed so that it extends from top to midpoint on one side of the edge member and midpoint to bottom on the opposing side. The loop material is reversed relative to the hook material. As shown, the alignment and attachment of adjacent modular panels takes place without any intermediate columns being used. Furthermore, no hardware or fixtures is required to complete the formation of a modular wall system. While the discussion has referred to joining panels edge to edge, the placement of alignment devices on the central portion of a wall permit a panel to project from that wall. Since the alignment device and fabric fasteners can be adhered to the surface of the panel by adhesive material, placement of these elements can be accomplished at the site if necessary. In addition to use with modular panels disposed in a vertical position as shown in FIG. 6, shelving and tables can be horizontally affixed to a panel in the same manner. Care must be taken to provide accurate location of the alignment devices and fabric fasteners if these steps are taken at the display site. In the embodiment of FIG. 7, the two side edges 45 and 46 of adjacent modular panels are formed at forty-five degrees to the panel surface. The alignment devices 46 and 47 are adhered to the surface of the respective side edges with the sockets 49 protruding inwardly of the panel. The releasable fastener material 50 is positioned on the side edges as previously discussed. The use of two angled side edges as shown provide a linear wall assembly. However, reversing one of the panels end for end provides a right angle corner as shown by the dashed lines of FIG. 7.

While the above description has referred to particular embodiments of the invention, it is to be noted that many modifications and variations may be made therein without departing from the scope of the invention as claimed.

We claim:

1. An alignment device for attachment to modular panels, said device facilitating assembly with adjacent panels, said device comprising:

a) a planar substrate for attachment to a panel, said planar substrate having opposing side edges;

b) a plurality of pairs of pin and socket formed in the planar substrate; each pair being laterally aligned and displaced from an adjacent pair, each said pair comprising:

i) a receiving socket formed in the substrate:

ii) a pin projecting from the substrate and positioned laterally adjacent to said socket, each pair of pin and socket being received by a like pair affixed to an adjacent panel.

2. The invention in accordance with claim 1 wherein each said pin is dimensioned for clearance when received in a socket.

3. The invention in accordance with claim 2 wherein each said socket is tapered.

4. The invention in accordance with claim 3 wherein each said pin has a rounded end.

5. The invention in accordance with claim 4 wherein each said socket has a concave bottom.

6. The invention in accordance with claim 5 wherein each said pin has a length less than the depth of the socket.

7. The invention in accordance with claim 1 wherein said pairs of pin and socket are alternately oriented.

8. The invention in accordance with claim 7 further comprising depending tabs affixed to the opposing side edges of the planar substrate, said tabs being inserted into the panel.

9. The invention in accordance with claim 8 wherein said tabs each extend outwardly from a side edge to form a shoulder for engaging the panel.

10. The invention in accordance with claim 9 wherein said device is formed of resilient plastic material to permit movement of the tabs during insertion into the panel.

11. A modular panel for removable attachment to a like panel which comprises:

a) a frame having top, bottom and opposing side members;

b) first and second engaging means affixed to one of the side members and located equidistant from the top and bottom members respectively, each of said engaging means including:

i) a planar base having side edges;

ii) a plurality of pairs of pin and receiving socket formed in said base, each pair being laterally aligned and displaced from an adjacent pair, each pair being oriented for receipt by a like pair affixed to a like panel; and c) releasable fastening means affixed to said one of the side members for engagement with fastening means on like panels, the first and second engaging means registering with engaging means on adjacent like panels and the fastening means securing adjacent like panels.

12. The invention in accordance with claim 11 wherein each pin is dimensioned for clearance when received in a socket to facilitate relative movement between adjacent panels.

13. The invention in accordance with claim 12 wherein said first and second engaging means each comprise a plurality of pairs of pin and socket, each pair being horizontally aligned and vertically displaced from an adjacent pair.

14. The invention in accordance with claim 13 wherein said one of the side members of the frame includes first and second openings for receiving the first and second engaging means respectively.

15. The invention in accordance with claim 14 wherein said first and second engaging means each comprise depending tabs affixed to the side edges of the planar base, said tabs being inserted into an opening in the side member.

16. The invention in accordance with claim 15 wherein said tabs each extend outwardly from a side edge of the base to form a shoulder for engaging the side member, the height of said shoulder being equal to the thickness of the side member of the frame.

17. The invention in accordance with claim 11 further comprising third and fourth engaging means affixed to the opposing side member and horizontally aligned with the first and second engaging means.

18. The invention in accordance with claim 17 wherein the sockets are tapered to facilitate relative movement between adjacent panels.

* * * * *